US005257468A

United States Patent [19]

Lebrun

[11] Patent Number: 5,257,468

[45] Date of Patent: Nov. 2, 1993

[54] AUTOMATIC DRYER AIR OUTLET HOSE QUICK-DISCONNECT COUPLING

[76] Inventor: Mario Lebrun, 2960 Bergemont, apt. 306, Québec, Province of Québec, G1J 5J9, Canada

[21] Appl. No.: 944,257

[22] Filed: Sep. 14, 1992

[51] Int. Cl.[5] ..... F26B 19/00

[52] U.S. Cl. ..... 34/235; 34/133 H; 454/359; 285/189

[58] Field of Search ..... 34/235, 133 R, 133 H; 454/347, 353, 359; 285/189

[56] References Cited

U.S. PATENT DOCUMENTS

| | | | |
|---|---|---|---|
| 3,171,343 | 3/1965 | Wexler | 454/359 |
| 4,334,461 | 6/1982 | Ferguson et al. | 34/235 |
| 5,121,948 | 6/1992 | Anderson et al. | 34/235 |

*Primary Examiner*—Henry A. Bennet
*Assistant Examiner*—Denise L. Gromada
*Attorney, Agent, or Firm*—Pierre Lespérance; François Martineau

[57] ABSTRACT

A dual coupler assembly to be mounted to the back wall of an automatic clothes drying machine for use with the flexible hose fluidingly connecting the air outlet port of the drying machine to outside ambient air. A first coupler includes a cylindrical flue releasably anchored to the drying machine back wall, while a second coupler includes a cylindrical flue anchored to the laundry room floor; in one embodiment, the flues are both horizontal, while in a second embodiment, the flues are vertical. In a third embodiment, one hose coupler is slidable along a ground rail integral to the second hose coupler, the latter being fixed to the ground; an operative position is defined, where the cylindrical flues of the two hose couplers become coaxial to one another. In all cases, by displacing the dryer towards the second coupler, the latter will engage edgewisely the first coupler to become coaxial therewith, wherein fluid-through communication is established. A first flexible hose interconnects the first flue to the machine air outlet port, while a second flexible hose interconnects the second flue to the outside.

12 Claims, 7 Drawing Sheets

AUTOMATIC DRYER AIR OUTLET HOSE QUICK-DISCONNECT COUPLING

FIELD OF THE INVENTION

This invention relates to air vent attachments for clothes drying machine air outlets.

BACKGROUND OF THE INVENTION

Installation of state of the art automatic clothes drying machine usually require skilled personnel. Indeed, water-saturated warm air exhaust from the machine must be evacuated from the laundry room, and therefore, suitable hose means must be installed to interconnect the machine air outlet port to an air exhaust port through a wall of the laundry room building, for evacuation of the warm air to outside ambient air. Care must be brought in sealing both ends of the air exhaust hose, to prevent leaks to the building rooms.

Upon maintenance being required or when replacement of the drying machine is required, one has to disengage the exhaust air hose, and reengage same to the new machine. Usually, the existing coupling means are simply an apertured, flanged plate with screws for anchoring same against the back-wall of the automatic dryer housing. Since the clothes dryer are often located in hard-to-reach corners of the laundry room, for obvious efficiency concerns in space allocation, its back wall is difficult to reach. Hence, disconnecting the air exhaust hose from the clothes dryer without damaging the hose itself may become an issue.

OBJECTS OF THE INVENTION

The objects of the invention are to address the problems outlined in the background of the invention paragraph.

Namely, a general object of the invention is to provide a coupling for the air exhaust hose of an automatic clothes drying machine, which will be of the self-installing or self-dismantling type, as a new drying machine is installed, or a worn-out machine is removed, respectively, from a dwelling.

A corollary object of the invention is to enable a layman to install himself the air exhaust hose to the automatic drying machine, without requiring any particular technical skills.

SUMMARY OF THE INVENTION

Accordingly with the object of the invention, there is disclosed a quick-disconnect hose-coupling assembly for use with the flexible hose that fluidingly interconnects the exhaust port of an automatic clothes drying machine to outside ambient air, over a laundry room flooring, comprising: (a) a first coupling member, defining a first main frame and a first flue fixedly carried by said first main frame, said first flue defining an axial channel having opposite exhaust air inlet and outlet ends; (b) first securing means for releasably anchoring said first main frame to the drying machine; (c) a second coupling member, defining a second main frame and a second flue fixedly carried by said second main frame, said second flue defining an axial channel having opposite exhaust air inlet and outlet ends; (d) second securing means, for fixedly anchoring said second main frame to the laundry room flooring; wherein said flues axial channels are parallel to one another and are to be brought in coaxial register in an operative position of said coupling members upon displacing said drying machine toward said second coupling member; whereby in said-operative position, said first flue air outlet and said second flue air inlet merge with one another, a first hose connected to said first flue air inlet being destined to evacuate exhaust air from said drying machine, and a second hose connected to said second flue air outlet destined to evacuate exhaust air from said first hose.

The invention relates also to a quick-disconnect hose-coupling assembly for use with the flexible hose that fluidingly interconnects the exhaust port of an automatic clothes drying machine to outside ambient air, over a laundry room flooring, comprising: (a) a first coupling member, defining a first main frame and a first flue fixedly carried by said first main frame, said first flue defining an axial channel having opposite exhaust air inlet and outlet ends; (b) first securing means for anchoring said first main frame to said room flooring; (c) a second coupling member, defining a second main frame and a second flue fixedly carried by said second main frame, said second flue defining an axial channel having opposite exhaust air inlet and outlet ends; and (d) rail means, integral to said first main frame, for guiding displacement of said second coupling member relative to the fixed said first coupling means about parallel planes, said parallel planes being approximately orthogonal to said flues axial channels; said second coupling means being movable to an operativie position, where said first and second coupling means come in coaxial register with one another upon displacing said drying machine toward said ground anchored first coupling member, from an inoperative position where said first and second coupling means are spaced apart; whereby in said operative position thereof, said first flue air outlet and said second flue air inlet merge with one another, in substantially fluid-tight fashion; a first hose being destined to be endwisely connected to said first flue air inlet for evacuating exhaust air from said drying machine, and a second hose being destined to be connected to said second flue air outlet for evacuating to the outside exhaust air from said first hose.

DETAILED DESCRIPTION OF THE INVENTION

Figure 1:
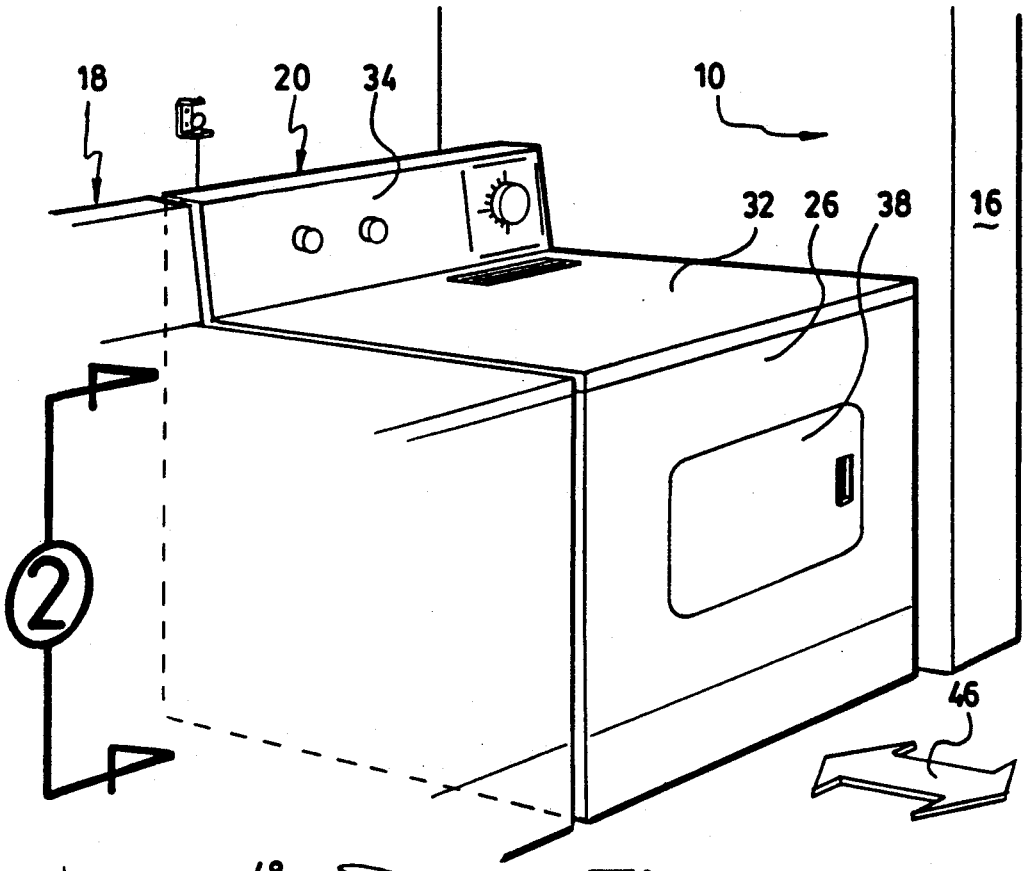
FIG. 1 is an isometric view of an automatic clothes drying machine, partly concealed by an adjacent automatic clothes washing machine shown only partially.

Laundry room 10 includes a flooring 12, a back wall 14 and an optional partition wall 16. A clothes washing machine 18 and a clothes drying machine 20 are to be located within laundry room 10. Each machine 18, 20 constitutes a large and heavy, box-like housing, rollably spacedly carried over ground 12 by idle rollers or swivel casters 22, for facilitating their displacement within the laundry room 10. Machines 18 and 20 are usually mounted side by side, preferably rearwardly against the back wall 14 and laterally against partition wall 16. Such an arrangement is desirable for obvious efficiency concerns in space allocation within the laundry room 10.

Looking more particularly to the drying machine 20, there is defined a closed housing having a bottom wall 24, front and rear walls 26, 28, two opposite side walls 30, a top wall 32, and a control panel 34 upwardly depending from the rear edge of top wall 32. A number of ground-engaging swivel casters 22 are spacedly mounted to bottom wall 24, wherein a vertical ground clearance 36 is defined between bottom wall 24 and the laundry room flooring 12. Access to the clothes loading area within housing 20 may be obtained through a door 38 hingedly mounted to front wall 26. Control panel 34 enables a user to operate a rotating drum surrounding the dryer clothes loading area, and to actuate a heating device for generating a heated air volume for drying the damp clothes being tumbled by the rotating drum. A fan (not illustrated) progressively evacuates the water-vapour saturated heated air volume through an air outlet port (not illustrated) conventionally mounted to the machine rear wall 28.

Figure 2:
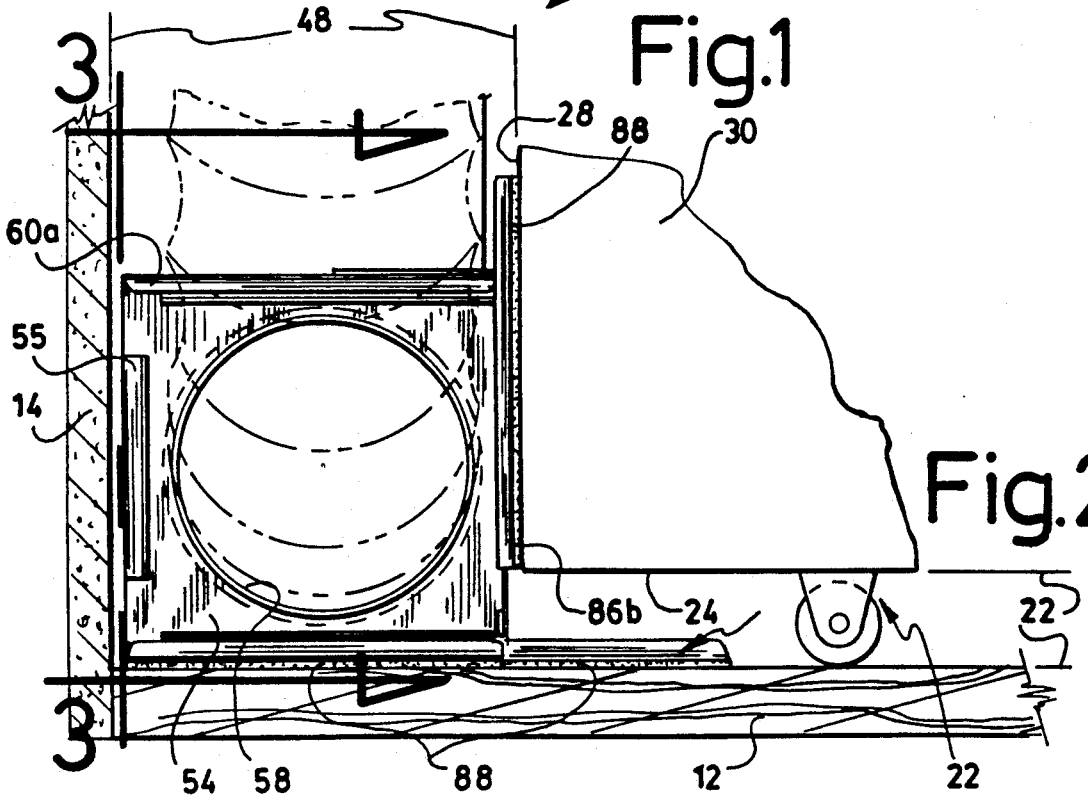
FIG. 2 is an elevational end view of a first embodiment of the air coupling device mounted to the rear of the drying machine, the latter at a larger scale than at FIG. 1.
Figure 2A:
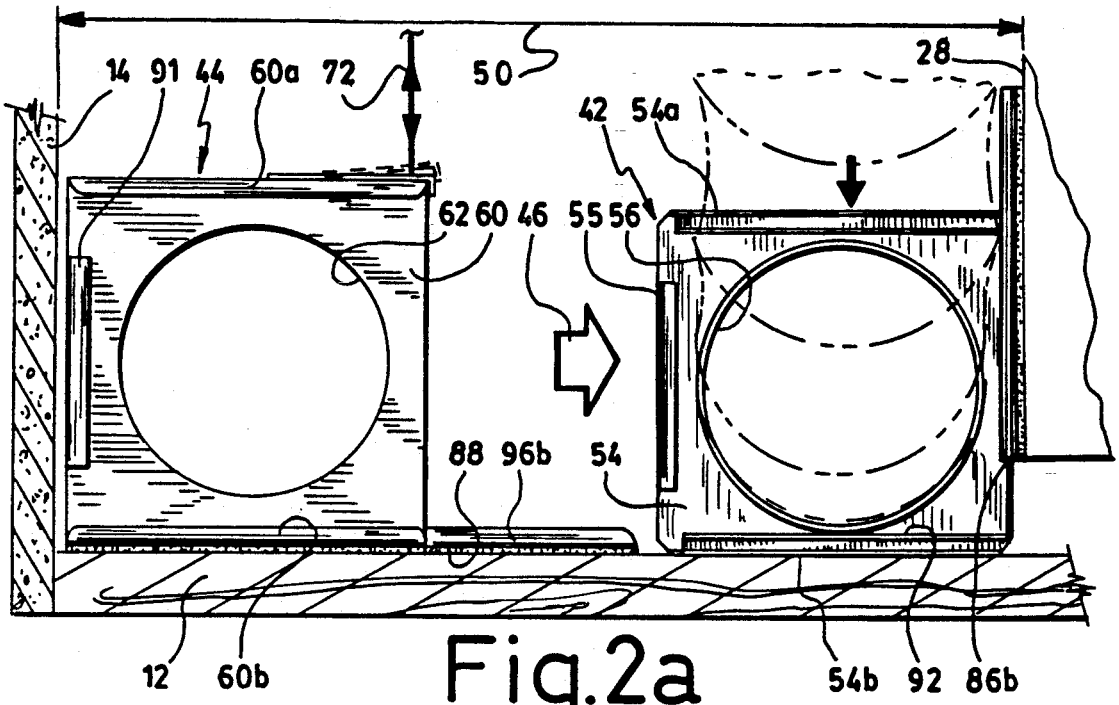
FIG. 2*a* is substantially similar to the FIG. 2, but with the air coupler being disassembled.

Accordingly with the invention, a first coupling member 42 is anchored to rear wall 28 proximal to said machine outlet port, while a second coupling member 44 is anchored to the laundry room flooring 12 adjacent back wall 14. Couplers 42, 44 are in substantial horizontal register, and are destined to matingly engage each other in their operative, assembled condition, as illustrated in FIG. 2, from their disassembled, released condition illustrated in FIG. 2*a*, through fore and aft displacement of housing 20, over flooring 12, rollingly with casters 22, as suggested by wide arrows 46 of FIGS. 1 and 2*a*. In their assembled, interconnected condition (FIG. 2), the pair of couplers 42, 44 defined a first horizontal clearance 48 between walls 14 and 28. Back wall clearance 48 may be larger than ground clearance 36, as illustrated. In their disassembled, released condition (FIG. 2*a*), the pair of couplers 42, 44 define a second horizontal clearance 50, which is necessarily greater than first clearance 48.

The first embodiment of couplings 42, 44 illustrated in FIGS. 2, 2*a* and 3–4 is destined for use with a flexible air outlet hose 52, which endwisely opens to the ambient air outside of the laundry room building, through an outlet port in a laundry room wall other than flooring 12, for example through back wall 14. Coupling 42 consists of a quadrangular plate 54, having a large circular through-bore 56. A rigid, cylindrical flue 58 edgewisely depends from plate 54, coaxially with bore 56, and is anchored thereto. Flue 58 is diametrally similar to bore 56. The top and bottom edge sections 54*a*, 54*b* of plate 54 are bent at right angle, on the side of flue 58, to constitute rectangular parallel flanges orthogonal to the lengthwise axis of flue 58. Flanges 54*a*, 54*b* extend radially outwardly of flue 58.

Coupling 44 consists of a quadrangular plate 60, having a large circular aperture 62. A rigid cylindrical flue 64 edgewisely depends from plate 60, coaxially with aperture 62, and is anchored thereto. Flue 64 is diametrally similar to aperture 62. The top and bottom edge sections 60*a*, 60*b* of plate 60 are bent on the side opposite flue 64, to constitute cross-sectionally U-shape flanges extending parallel to one another and orthogonal to the lengthwise axis of flue 64. Each flange 60*a*, 60*b* defines a mouth or channel 60*c*, 60*d* respectively opening one toward the other. Flanges 60*a*, 60*b* extend radially outwardly of bore 62. Mouths 60*c*, 60*d* are widthwisely smaller than rectangular flanges 54*a*, 54*b* of plate 54, and plate 54, slightly shorter than plate 60. Hence, the free faces of plates 54, 60 are slidable flatly one against the other, guidingly by the lengthwise, sliding rail engagement of flanges 54*a*, 54*b* into and through U-channels 60*c*, 60*d*.

Means 66 are provided to releasably lock the coupler halves 42, 44 in their assembled condition. Locking means 66, best illustrated in FIG. 4, includes a spring-loaded metal strip 68, anchored to flange 60*a* and having a free end tongue 68*a* projecting beyond the leading edge thereof at 60*a*'. Strip 68 extends along a plane orthogonal to wall 60. Tongue 68*a* has an inturned end lip 70. A cord 72 is endwisely anchored to tongue 68*a*, and provided at its opposite end with a finger-engageable ring 74. A U-shape bracket 76 is anchored to an upper portion of laundry room back wall 14, in register with coupler 44. The lower leg 78 of U-bracket 76 includes a through-bore 78*a* through which freely extends cord 72, while the upper leg thereof at 80 is releasably engaged by ring 74. The length of cord 72 is adjusted to be slightly longer than the distance between lower strip 68 and upper bracket lower leg 78. Hence, upon forcibly hooking ring 74 onto the bracket upper leg 80, cord 72 will lift tongue 68*a*, thereby biasing lip 70 to clear the flange leading edge 60*a*'. Thus, when coupler 42, 44 is fully assembled, ring 74 is released from top leg 80, wherein lip 70 will engage the trailing end 54' of flange 54*a*, to prevent unauthorized disassembly thereof. For release of coupler halves 42, 44, ring 74 is again lifted, biasing cord 72 to pull tongue 68*a* away from flange leading edge 60*a*'.

Coupler 42 anchored to wall 28 is preferably releasably so, by anchor means 82. Anchor means 82 includes a first plate 84, edgewisely orthogonally depending from plate 54 on the side of trailing edge 54*a*'. The two opposite edge sections 84*a*, 84*b* of plate 84 that are orthogonal to flanges 54*a*, 54*b* form free vertical ledges. A second plate 86 is anchored flatly against drying machine wall 28, and defines two opposite side edge sections bent in cross-sectionally U-shape flanges 86*a*, 86*b*. Vertical channels 86*c*, 86*d* formed by flanges 86*a*, 86*b* are slidingly vertically engageable by ledges 84*a*, 84*b* whereby first plate 84 is slidable flatly against second plate 86.

Preferably, the anchoring means for anchoring bracket 76 to wall 14, coupler 44 to flooring 12, and rail plate 86 to wall 28, each consists of self-adhesive strips 88.

Advantageously, structure reinforcing means are provided to improve the sturdiness of air vent attachments 42, 44, namely: triangular plates 90, edgewisely anchoringly engaging the two opposite free edge sections of plate 60 orthogonally thereto and on the side of flue 64; and triangular plates 92, interconnecting plates 54 and 84 orthogonally thereto proximate to flanges 54*a*, 54*b* respectively, and to the edge sections of quadrangular plate 84 orthogonal to edges 84*a*, 84*b*.

Profitably, a rail guide member 94 is mounted to flooring 12 in spaced axial register with the leading edge 60*b*' of ground-engaging flange 60*b* of coupler 44. Rail guide member 94 is a funnel-like triangular plate 96 having two upturned long edge flanges 96*a*, 96*b*, the narrow end mouth 96*c* of funnel 96 facing the flange leading edge 60*b*' while the wide end mouth 96*d* of funnel 96 is destined to be engaged by the leading edge 54*b*' of the ground engaging flange 54*b* of the drying machine anchored coupler 42. Funnel 96 is anchored to flooring 12 preferably by a self-adhesive strip 88. Funnel 96 is released by coupler 42 in both assembled and disassembled condition thereof, but flange 54*b* of coupler 42 slidingly engages the surface of panel 96 of funnel 94 during displacement toward coupler 44.

Figure 4:
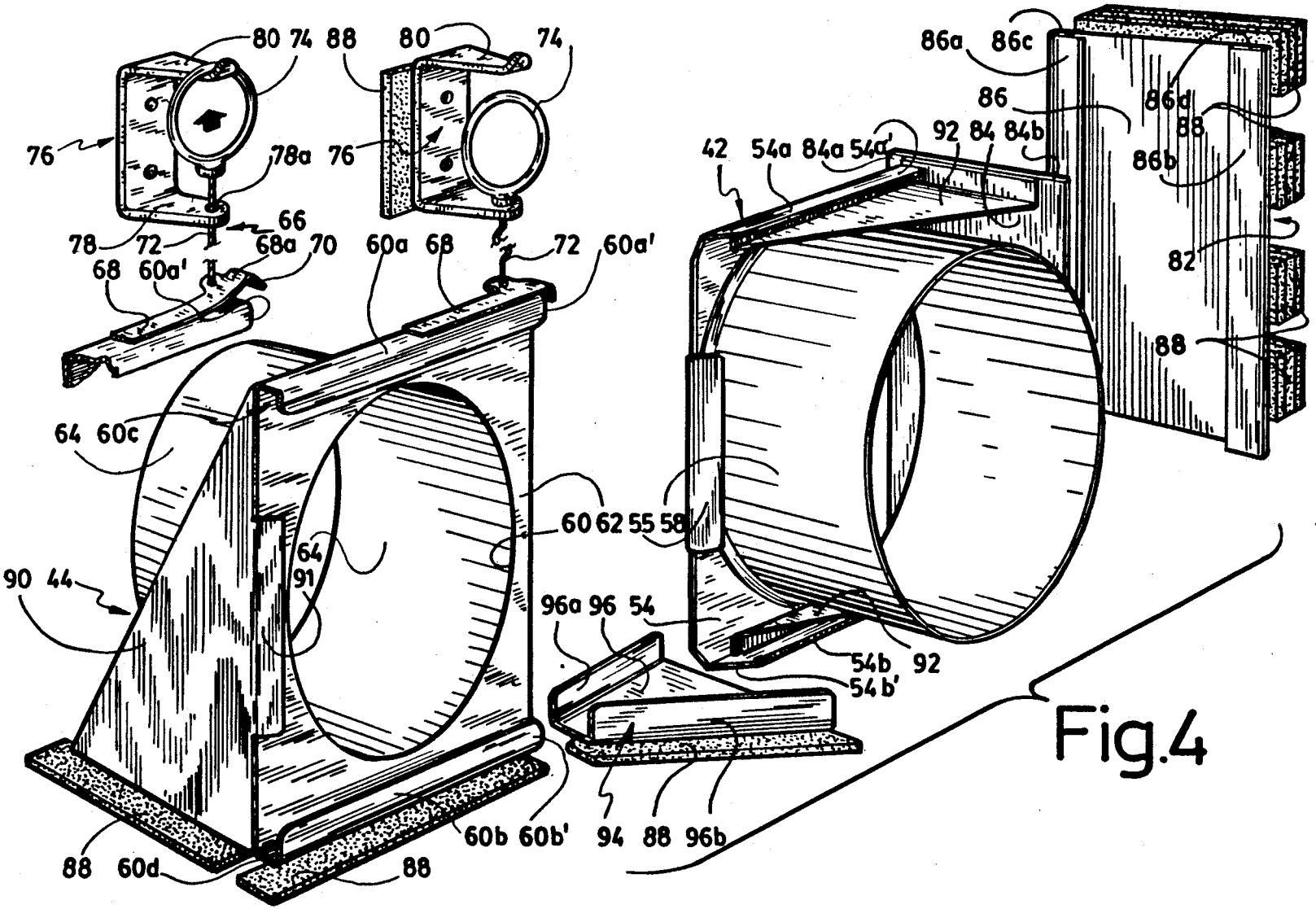
FIG. 4 is an exploded view, at an enlarged scale, of the air coupler components from the first embodiment of the invention.

As suggested in FIG. 4, the edgewise anchor means for securing flues 58, 64 to plates 54, 60 respectively, may be bent edgewise extensions of an intermediate section of these latter plates, such as reference 55 of plate 60. Similarly, bent extensions 91 of strut 90 may secure the latter to plate 60.

Figure 3:
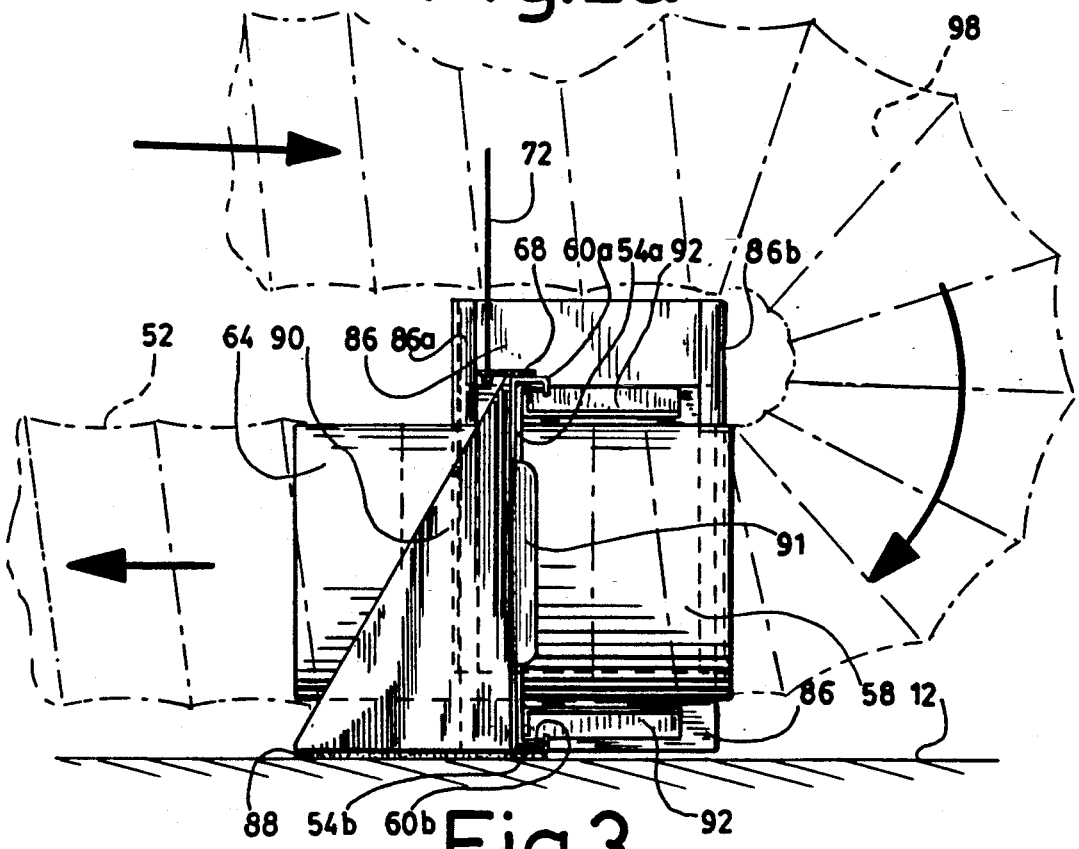
FIG. 3 is a view taken from perspective 3 of FIG. 2, suggesting how the flexible air discharge hose, shown in phantom lines, is connected to the air coupler of the invention accordingly with a first embodiment of the invention.

As suggested in FIG. 3, the air outlet port on back wall 28 of drying machine 20 is destined to be fluidingly connected to the rigid flue 58 by a large flexible hose 98. Hose 98 is similar to flexible hose 52, the latter fluidingly interconnecting rigid flue 64 to an outlet port of the laundry room building. when couplers 42, 44 are assembled together, flues 58 and 64 become coaxial and thus, hoses 52, 98 are in fluid communication. Hoses 52, 98 may be of the conventional accordion type.

Figure 5:
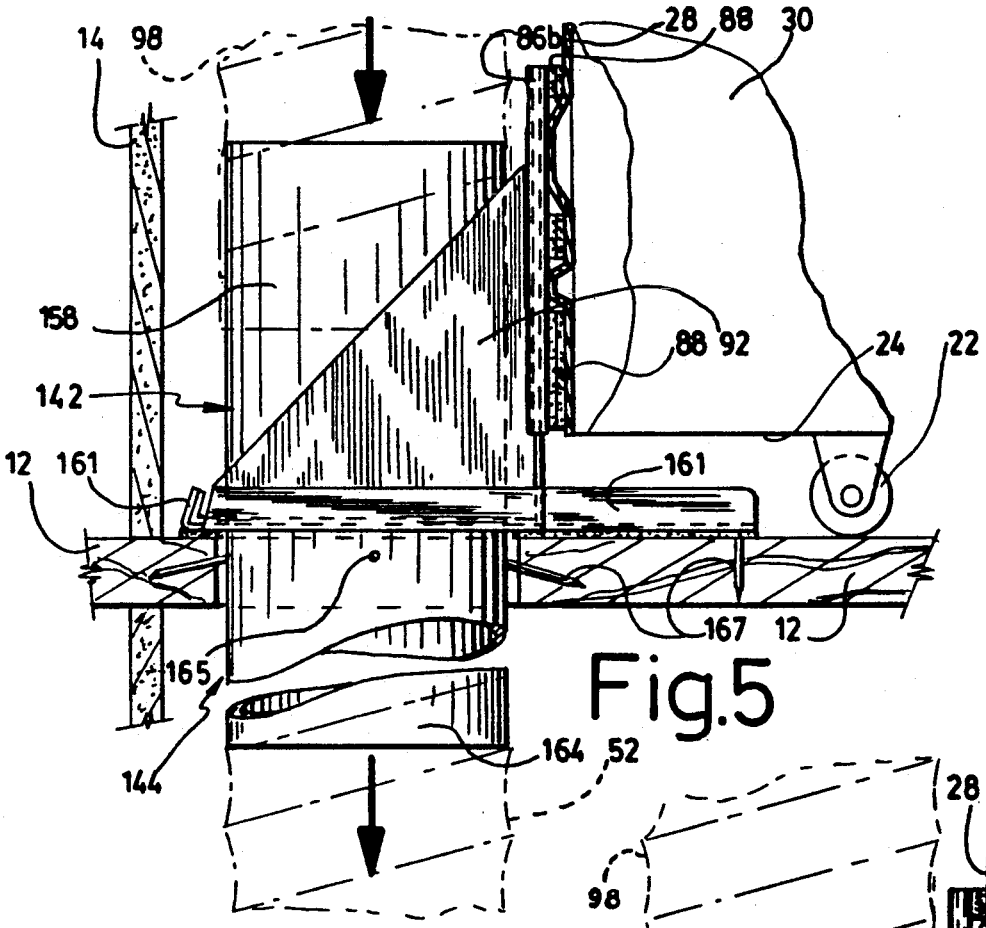
FIGS. 5 and 5*a* are views similar to FIG. 3, but showing a second embodiment of air coupler installation driven through the ground, respectively in assembled and disassembled condition.
Figure 5A:
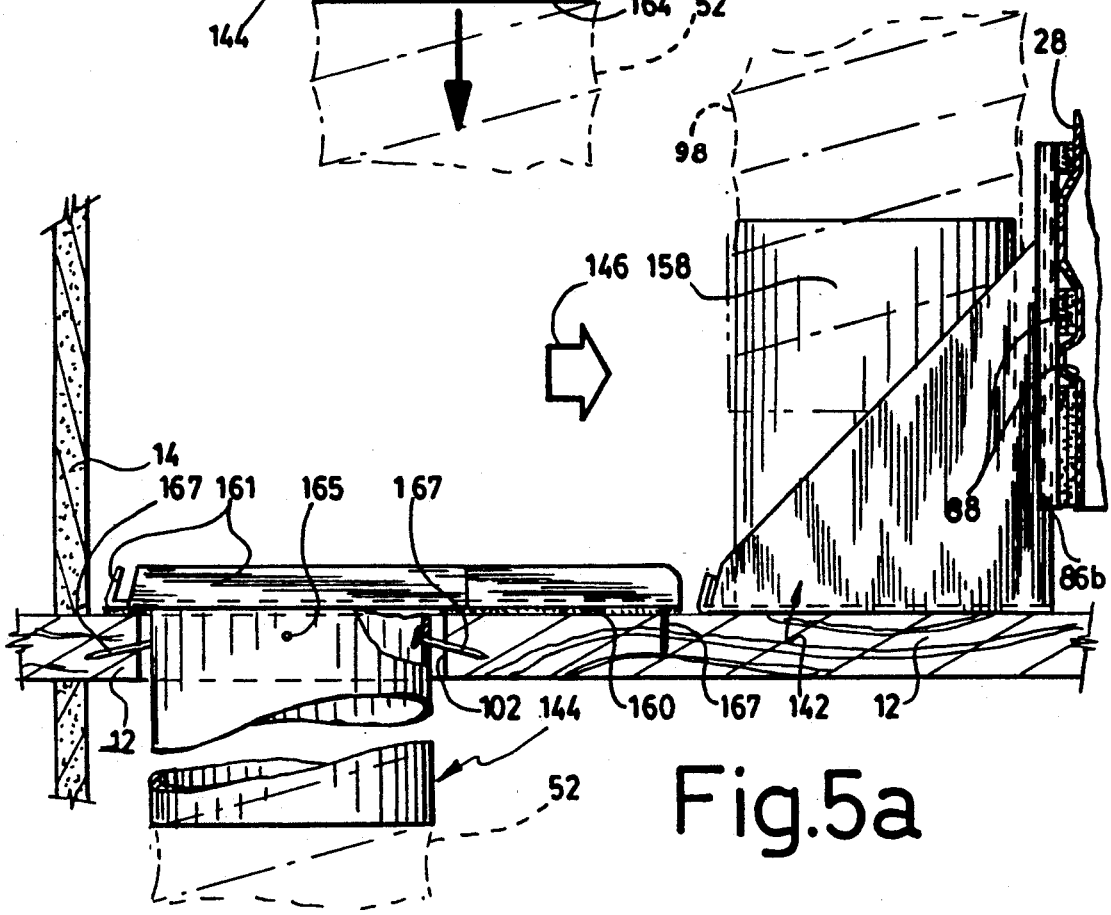
Figure 6:
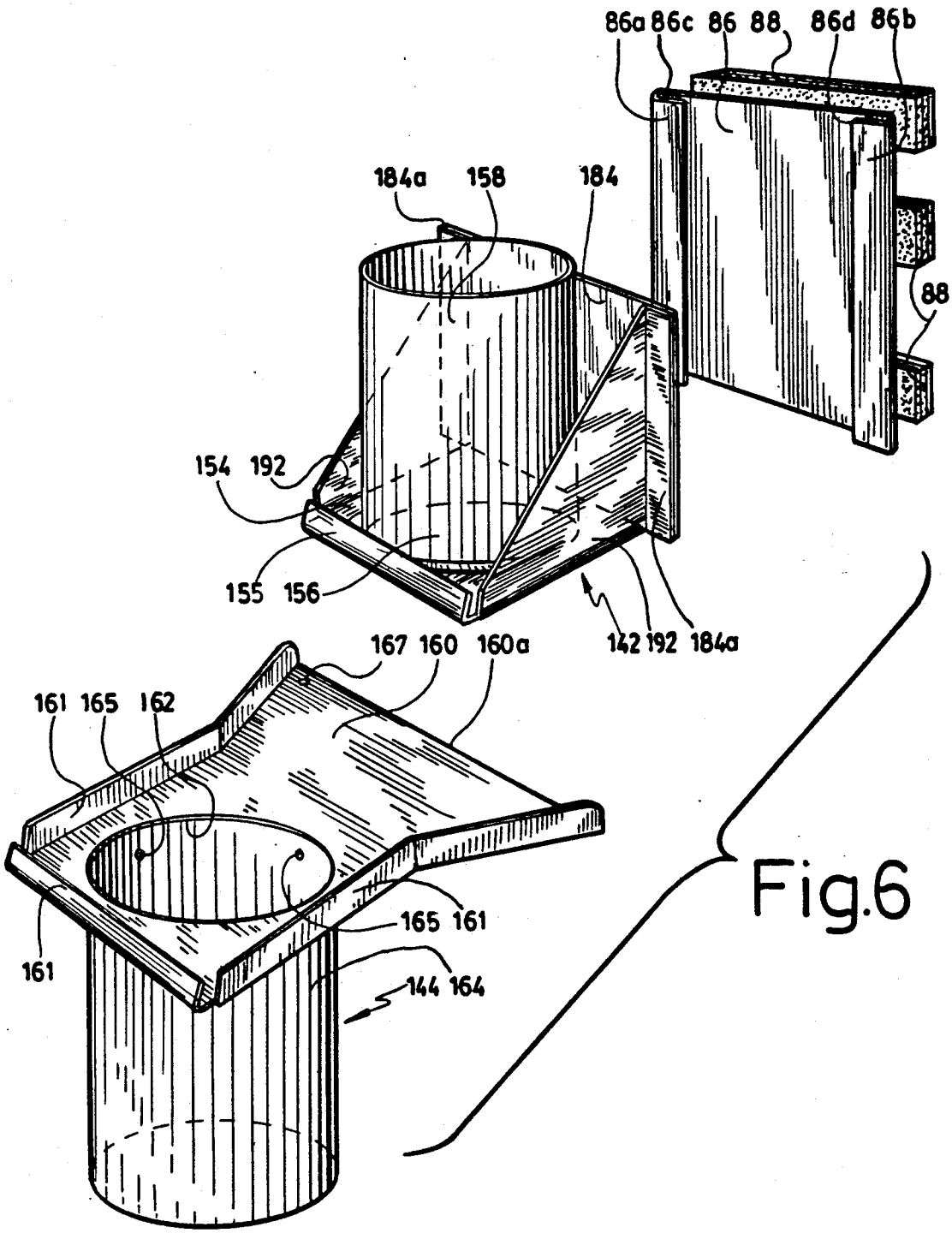
FIG. 6 is an exploded view of the second embodiment of the drying machine air coupler.
Figure 9:
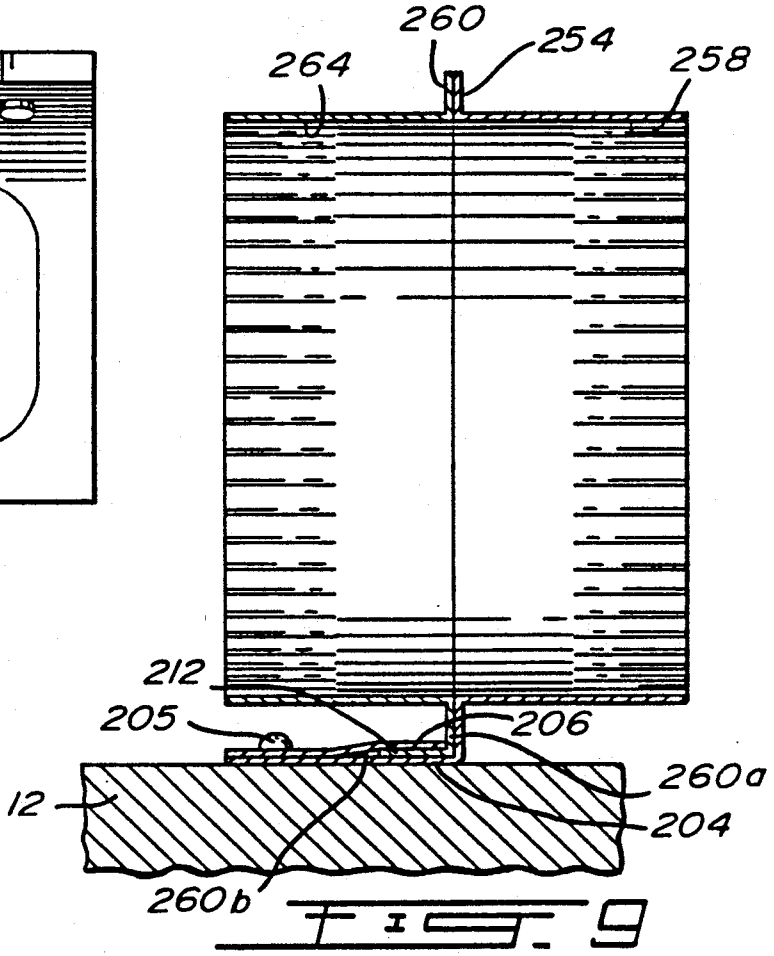
FIG. 9 is a sectional view of part of the third embodiment of coupling device, shown attached to a cut-away portion of drying machine.

The second embodiment of warm air exhaust attachment is illustrated in FIGS. 5, 5*a* and 6 and referenced 142 and 144 for the two coupling halves. In the same way as coupler 42, coupler 142 includes a rigid cylindrical flue 158 endwisely engaging an apertured plate 154 coaxially to bore 156, and another plate 184 is edgewisely orthogonally carried by plate 154 for slidingly edgewisely engaging at 184*a*, 184*b* the rail channels 86*c*, 86*d* of the dryer machine back wall plate 86. However, whereas flue 58 was in assembled condition axially horizontal and parallel to channels 86*c*, 86*d*, flue 158 is vertically upstanding and parallel to channels 86*c*, 86*d*. Thus, triangular struts 192 are also vertical but orthogonal to channels 86*c*, 86*d* compared to the first embodiment struts 92 which were horizontally extending and orthogonal to channels 86*c*, 86*d*. The free edge of plate 154 opposite plate 184 forms a full length inturned flange 155, directed toward the side of flue 158.

Coupler 144 defines a main polygonal horizontal plate 160, having a large circular bore 162 from which downwardly edgewisely depends a cylindrical rigid flue 164. Flue 164 engages and extends through and beyond an aperture 102 made in the laundry room floor 12, to open into a room 104 beneath laundry room 10. The inner mouth of flue 164 proximate plate aperture 162 includes peripheral bores 165 for through engagement by nails 167 to be hammered thicknesswisely of flooring 12 within floor aperture 102, in such a way that plate 160 horizontally flatly abuts against the top face of flooring 12. Horizontal plate 160 defines a free leading edge 160*a* for sliding engagement thereover of leading edge 155 of coupler 142, wherein horizontal plate 154 of coupler 142 will slide horizontally over horizontal ground plate 160 of coupler 144 to bring flues 158 and 164 in coaxial vertical register, upon displacing drying machine 20 rearwardly toward back wall 14. Plate 160 is also nailed to flooring 12 by transverse nails 167.

Advantageously, all the edges of plate 160 other than leading edge 160*a*, form upturned flanges 161, which will enable automatic positioning of flue 158 coaxially to flue 164 by fully engagement of plate 154 over plate 160 edgewisely against these flanges 161. Preferably, the leading edge portion of plate 160 is funnel shape, as illustrated in FIG. 6, with leading edge 160*a* being the widest section thereof, for promoting guiding displacement of coupler 142 over plate 160 of coupler 144.

Again, a flexible hose 98 fluidingly interconnects rigid flue 158 to the outlet port (conventional, not illustrated) on the dryer back wall 28, while a separate flexible hose 52 interconnects rigid flue 164 to the outside of the building 10 through an outlet port.

In this second embodiment of the invention, no means is provided to prevent unauthorized release of couplers 142, 144 as when pulling machine 20 away from laundry room back wall 14, see arrow 146 in FIG. 5*a*.

The third embodiment of coupler device is shown as reference 200 in FIGS. 7 to 10. Coupler device 200 includes a pair of upright quadrangular plates 254 and 260, each having a large circular through-bore 256 and 262 respectively, from which edgewisely depend transverse cylindrical flues 258, 264 respectively, on alternate sides thereof. A narrow, rectangular strip plate 204 is integrally mounted to the bottom edge 254*a* of quadrangular plate 254, orthogonal to the plane of the latter. Strip plate 204 is on the side of flue 264, opposite flue 258. Elongated guide strip 204 is at least longer than edge 254*a* of plate 254. Ground-engaging strip 204 is anchored flatly to floor 12 by screw means 205, and includes a second lengthwise, integral strip 206 diverging upwardly inwardly from an intermediate width section of strip 204, toward plates 254, 260, wherein a thin lengthwise horizontal channel 208 is defined between strips 204 and 206. Strip 206 further extends inwardly slightly short of the plane of flue plate 254, so that a narrow lengthwise, vertical slit 210 be defined.

Flue plate 260 includes a short flange 212 (FIG. 9), integral to its bottom edge portion 260*a* orthogonal thereto. As suggested in FIG. 8, flange 212 is preferably tapered along its long free edge 260*b*.

It can now be understood that the bottom edge portion of flue plate 260 is slidingly engaged into vertical slit 210, while flange 212 of flue plate 260 becomes slidingly engaged into horizontal channel 208. The cross-section of flange 212 substantially corresponds to that of channel 208, whereby the sliding motion of the former through the latter is done with substantially no wobble motion. Flue plate 260 can then be guided in motion about a plane parallel to and slightly offset from flue plate 254, on the side opposite flue 258 of flue plate 254.

Therefore, upon selectively displacing movable flue member 260, 264 edgewisely along rail 208, 210, the free faces (free of flue ducts 258, 264) and eventually the apertures 256, 262 at the center of the free faces of plates 254, 260, will eventually come in exact axial register with one another, adjustably to an operative position. At this operative condition, the air exhaust hoses 52', 98', connected to flues 258, 264, come in axial register with one another for direct air flow, from the air outlet of automatic dryer 20 toward the ambient air outside of room 16.

To facilitate displacement of movable flue plate 260 along horizontal rail 208, away from fixed flue plate 254, as when a worn-out dryer machine 20 is to be removed for a new one, a pull cord 214 is connected to an ear 216 depending from the outer side edge **260*b* of the movable flue plate 260, and to another ear 217 depending from the back wall 20*a* of dryer 20 close to the dryer air outlet port 20*b***.

Spring loaded clips 218, 220 are carried on the free faces of flue plates 254, 260 respectively, opposite flue hoses 258, 264, respectively, on their trailing edge sections **254*b*, 260*b*, and preferably at the lower end of edge section 254*b* (proximate ground stips 204, 206) and at the upper free end of outer edge section 260*b* of flue plate 260. Each clip 218, 220 is generally U-shape, fitting around the body of respective plates 254, 260, and defining a diverging, outturned lip 218*a*, 220*a*, respectively on the free faces of plates 254, 260**.

Hence, as movable flue plate 260 progressively moves toward fixed flue plate 254, guidingly by long rails 208, 210, the former plate becomes biased by the clip lips **218*a*, 220*a* to come about a plane exactly parallel to and very close to that of the latter plate. The main body of spring-loaded clips 218, 220 will then continuously bias flue plates 254, 260, flatly and directly against one another, on their free faces, whereby upon flue plate circular apertures 256, 262 coming in exact axial register with one another—as suggested in FIG. 10—, a substantially fluid-tight interconnection is obtained between flue plates 254 and 260: to wit, the operative position of coupler 200**.

Each clip 218, 220 is anchored to its corresponding flue plate 254, 260 by a rivet 222 or other anchor means.

Figures 8, 10:
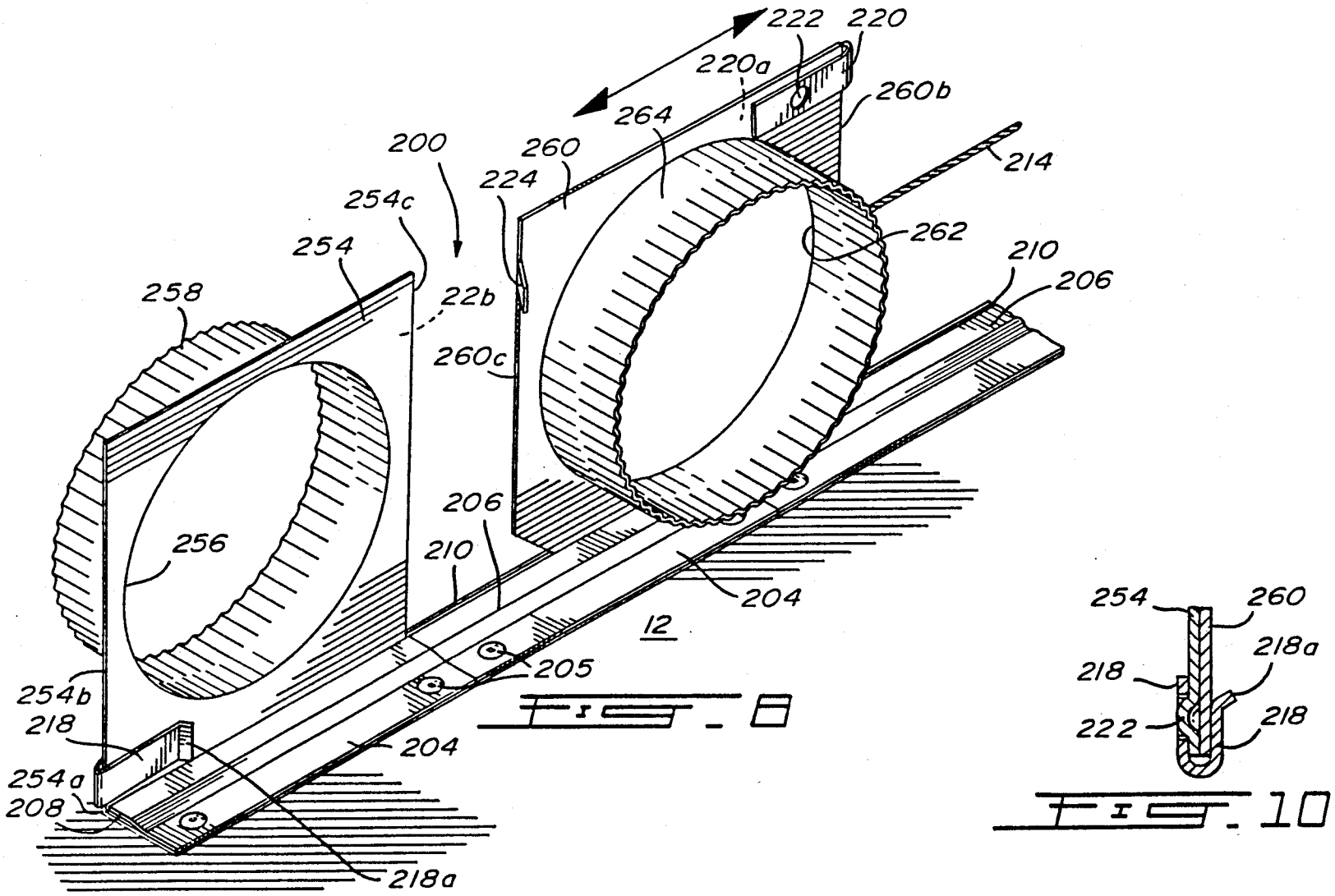
FIG. 8 is a perspective view of said third embodiment of the coupling device of the invention.
FIG. 10 is a cross-section of the left hand side clipper portion of the coupler device illustrated in FIG. 8.

Preferably, and as suggested in FIG. 8, flue plates 254, 260 each carry on their leading edges **254*c*, 260*c* transverse, self registering, diverging fingers 224, 226 respectively projecting obliquely on the side of their corresponding flue pipes 258, 262. Fingers 224, 226 are destined to prevent movable plate 260 from sliding exteriorly of the free face of fixed plate 254, that is, to prevent leading edge 260*c* from abutting against flue 258, thus undesirably preventing operative coaxial alignment of flues 258 and 264**.

Figure 7:
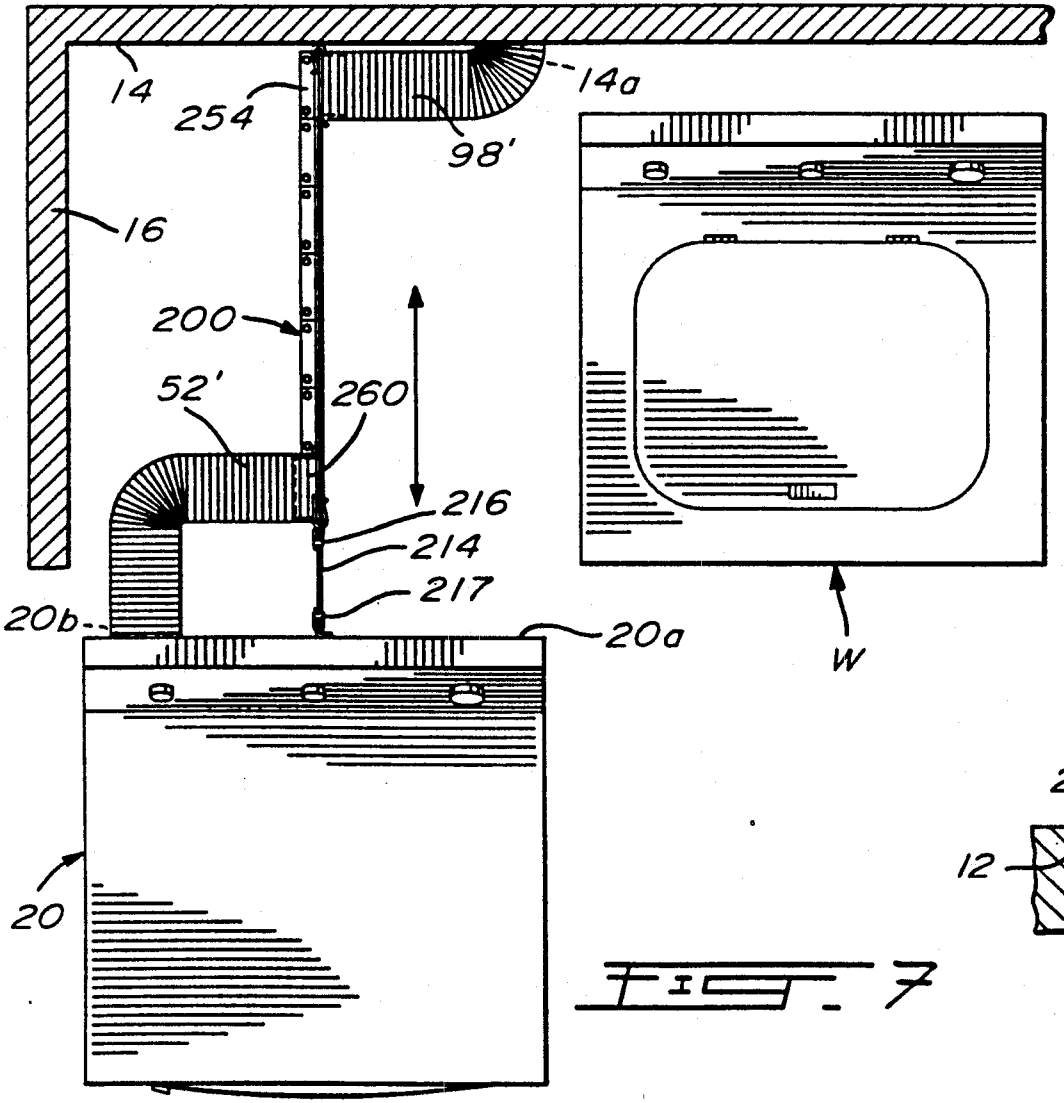
FIG. 7 is a top plan view of an automatic clothes dryer and associated air discharge coupler device, in accordance with a third embodiment of the invention, the double arrow suggesting how the air coupling device automatically sets in operative position upon rearward motion of the clothes dryer toward the back wall of the room, reference W designating a nearby washing machine.

In operation, and as can be readily understood from FIG. 7, hose 52'—which may already be connected to flue 264 of movable plate 260—, is then connected at the opposite end to the automatic dryer 20, while hose 98, —which may already be connected to flue 258 of fixed plate 254—, connects at its opposite end with an outlet port **14*a* in the room back wall 14 (for exit to the outside of the building). Movable flue plate 260 is engaged through the end mouth of channel 208, 210, opposite clip 208 of the fixed coupling plate 254, in order to releasably secure flue plates 254 and 260 to one another. Movable flue plate 260 is then slidingly displaced therealong, toward the fixed flue plate 254, simply by pushing machine 20 toward wall 14, as suggested by the double arrow in FIG. 7. Eventually, flue apertures 256, 262 become coaxial to one another, in said operative position illustrated in FIG. 9. The dryer 20** is then immobilized in this ground position.

I claim:

1. A quick-disconnect hose-coupling assembly for use with the flexible hose that fluidingly interconnects the exhaust port of an automatic clothes drying machine to outside ambient air, over a laundry room flooring, comprising:

(a) a first coupling member, defining a first main frame and a first flue fixedly carried by said first main frame, said first flue defining an axial channel having opposite exhaust air inlet and outlet ends;

(b) first securing means for releasably anchoring said first main frame to the drying machine;

(c) a second coupling member, defining a second main frame and a second flue fixedly carried by said second main frame, said second flue defining an axial channel having opposite exhaust air inlet and outlet ends;

(d) second securing means, for fixedly anchoring said second main frame to the laundry room flooring;

wherein said flues axial channels are parallel to one another and are to be brought in coaxial register in an operative position of said coupling members upon displacing said drying machine toward said ground anchored second coupling member; whereby in said operative position thereof, said first flue air outlet and said second flue air inlet merge with one another; a first hose to be endwisely connected to said first flue air inlet for evacuating exhaust air from said drying machine, and a second hose to be connected to said second flue air outlet for evacuating to the outside exhaust air from said first hose.

2. A quick-disconnect hose-coupling assembly as defined in claim 1, wherein said first main frame includes a first vertical plate having a large cylindrical aperture, said first flue forming a first rigid horizontally extending cylinder endwisely anchored to one face of said first plate edgewisely of said aperture thereof; said second main frame including a second vertical plate having a large cylindrical aperture, said second flue forming a second rigid horizontally extending cylinder endwisely anchored to one face of said first plate edgewisely of said aperture thereof; said vertical plates each defining another face opposite said one face thereof, said another faces flatly abutting against each other in said operative positions of said coupling members.

3. A quick-disconnect hose-coupling assembly as defined in claim 2, wherein said first main frame includes a first horizontal plate having a large cylindrical aperture, said first plate freely abutting flatly against the laundry room flooring, said first flue forming a first rigid vertically upstanding cylinder endwisely anchored to one face of said first plate edgewisely of said aperture thereof; said second main frame including a second horizontal plate having a large cylindrical aperture, said second flue forming a second rigid vertically downwardly extending cylinder endwisely anchored to one face of said first plate edgewisely of said aperture thereof; said horizontal plates each defining another face opposite said one face thereof; wherein, in said operative position of said coupling members, said first plate is lifted over the flooring by slidingly engaging said second plate one face with said second plate another face flatly engaging the laundry room flooring and said second flue extending through this flooring.

4. A quick-disconnect hose-coupling assembly as defined in claim 1, further including means for guiding the displacement of said first coupling member to bring said first flue automatically in coaxial register with said second flue.

5. A quick-disconnect hose-coupling assembly as defined in claim 2, further including rail guide means embodied into said coupling members for guiding the displacement of said coupling members so that said vertical plates thereof move along parallel planes proximate each other.

6. A quick-disconnect hose-coupling assembly as defined in claim 5, wherein said rail guide means includes first and second flange means, horizontally extending along the top edges of said first and second vertical plates, respectively, said flange means slidingly engaging one another upon said vertical plates coming in sliding transverse respective register; and further including latch means, for releasably interconnecting said flange means in said operative position of the coupling members, to prevent unauthorized disengagement of said coupling members from their said operative interconnected condition.

7. A quick-disconnect hose-coupling assembly as defined in claim 6, further including remote-control, manual deactivation means for deactivating said latch means to release said coupling members from one another.

8. A quick-disconnect hose-coupling assembly as defined in claim 2, wherein to said first plate is edgewisely anchored a vertically upright third plate, said third plate defining a pair of free opposite side edges; and wherein said first securing means consists of a fourth plate, flatly anchored against a flat wall of said drying machine and defining opposite edgewise side channel members slidingly releasably engaged by said third plate side edges.

9. A quick-disconnect hose-coupling assembly for use with the flexible hose that fluidingly interconnects over a laundry room flooring the exhaust port of an automatic clothes drying machine to outside ambient air, and comprising:

(a) a first coupling member, defining a first main frame and a first flue fixedly carried by said first main frame, said first flue defining an axial channel having opposite exhaust air inlet and outlet ends;

(b) first securing means for anchoring said first main frame to said room flooring;

(c) a second coupling member, defining a second main frame and a second flue fixedly carried by said second main frame, said second flue defining an axial channel having opposite exhaust air inlet and outlet ends; and (d) ground rail means, integral to said first main frame, slidingly carrying said second main frame for guiding displacement of said second coupling member relative to the fixed said first coupling member about a plane approximately orthogonal to said flues axial channels;

said second coupling member being movable to an operative position, where said first and second flues come in coaxial register with one another, from an inoperative position, where said first and second flues do not open into one another; whereby in said operative position, said first flue air inlet and said second flue air outlet merge with one another, in substantially fluid-tight fashion; a first hose being destined to be endwisely connected to said second flue air inlet, for evacuating exhaust air from said drying machine, and a second hose being destined to be connected to said first flue air outlet, for evacuating to the outside exhaust air from said first hose in said operative position.

10. An automatic dryer hose coupling assembly as in claim 9, with said first and second main frames including upright first and second plates respectively, each said upright plate defining a vertical leading edge and a trailing edge opposite said leading edge, said leading edges of said first and second plates facing one another in said inoperative position of said second coupling means; said first and second flues projecting from opposite directions from said first and second upright plates, respectively, whereby each said upright plate defines a free face opposite the corresponding flue;

further including tilt means, carried by the top portion of said second upright plate leading edge, for biasing said second plate toward the side of said first plate free face, upon said second plate leading edge coming in transverse register with said first plate leading edge, said tilt means preventing engagement of said first plate with said second flue and of said second plate with said first flue.

11. An automatic dryer hose coupling assembly as in claim 10, further including a first spring-loaded clip member, carried by the bottom portion of said first plate trailing edge, for biasing said first and second plates free faces flatly against one another, upon said second plate leading edge coming in transverse register with said first plate trailing edge, at a position corresponding to said operative position.

12. A hose coupling assembly for an automatic drying machine as defined in claim 11, further including a second spring-loaded clip member, carried by the top portion of said second plate trailing edge, for further biasing said first and second plates free faces flatly against one another upon said second plate leading edge coming in transverse register with said first plate trailing edge at a position corresponding to said operative position.

* * * * *